United States Patent [19]

Leonard

[11] 4,090,583

[45] May 23, 1978

[54] STREAMLINED MONOLITHIC INTERNAL COMBUSTION ENGINE MUFFLER

[76] Inventor: James L. Leonard, 8631 E. Roanoke, Scottsdale, Ariz. 85257

[21] Appl. No.: 654,188

[22] Filed: Feb. 2, 1976

[51] Int. Cl.[2] ..... F01N 7/10; F01N 1/08

[52] U.S. Cl. ..... 181/240; 181/243; 181/268; 181/282; 181/404

[58] Field of Search ..... 181/56, 60, 49, 69, 181/36 A, 42, 40, 72, 61, 240, 243, 268, 282

[56] References Cited

U.S. PATENT DOCUMENTS

| | | | |
|---|---|---|---|
| 1,070,600 | 8/1913 | Haugen | 181/56 |
| 1,821,688 | 9/1931 | Bourne | 181/72 |
| 2,484,826 | 10/1949 | Harley | 181/61 |
| 3,009,531 | 11/1961 | Mead | 181/61 |
| 3,482,649 | 12/1969 | Murphy | 181/60 |
| 3,497,031 | 2/1970 | Kedziora | 181/40 |
| 3,669,216 | 6/1972 | Spies | 181/60 |
| 3,695,388 | 10/1972 | Paxhia et al. | 181/60 |
| 3,779,342 | 12/1973 | Broberg, Jr. | 181/56 |
| 3,880,252 | 4/1975 | Mucka | 181/60 |
| 3,923,120 | 12/1975 | Jatcko | 181/49 |

*Primary Examiner*—Stephen J. Tomsky
*Attorney, Agent, or Firm*—Cahill, Sutton & Thomas

[57] ABSTRACT

A streamlined monolithic internal combustion engine muffler is disclosed, which muffler deadens the noise generated during combustion and diffuses the gaseous composition exhausted into the atmosphere.

17 Claims, 4 Drawing Figures

STREAMLINED MONOLITHIC INTERNAL COMBUSTION ENGINE MUFFLER

The present invention relates to sound muffling devices and, more particularly, to monolithic mufflers for internal combustion engines.

In the field of modeling activities, internal combustion engines having displacements ranging from 0.01 cubic inches to 1 cubic inch are often employed to power airplanes, boats, cars and other vehicles. These engines are not quiet and as the activities are often conducted in populated areas, mufflers must be employed to reduce the noise to an acceptable level. To meet this need, many mufflers have been developed. Of these, the most effective type are those referred to as expansion mufflers. That is, the exhaust gases are expanded within a chamber to reduce the velocity of the gases and subsequently expelled from the chamber into the atmosphere through a short length of pipe or tubing. These mufflers, while generally considered adequate in suppressing the noise, impose a severe power loss penalty due to back pressure. Moreover, the need for a large chamber renders the mufflers bulky, which precludes burying them within a cowling. Therefore, the expansion mufflers extend into the air stream of the vehicle and create drag. The construction of these mufflers is generally of sheet materials which, at certain frequencies, have a tendency to reverberate and contribute further noise.

A second general category of mufflers are those which establish a tortuous path for the exhaust gases and thereby turbulate the flow by multiple reflections to reduce the exhaust gas velocity and deaden the noise. U.S. Pat. No. 3,779,342, is representative of this type of a muffler used in conjunction with miniature internal combustion engines. These mufflers are generally adequate in their capability of suppressing exhaust noises but they suffer from several disadvantages. Unless the path of the exhaust gases through the muffler is sufficiently long, back pressure is created which reduces the power output of the engine; thus, a tradeoff must be made between sound dampening capability and acceptable size. Where plates of one type or another are employed to establish the tortuous path, reverberation may occur at some or all engine speeds, which reverberation exacerbates the noise problem.

It is therefore a primary object of the present invention to provide a small sized effective muffler for internal combustion engines.

Another object of the present invention is to provide a muffler which does not employ an expansion chamber.

Yet another object of the present invention is to provide a monolithic muffler.

Still another object of the present invention is to provide a muffler which may be easily machined from a solid piece of material.

A further object of the present invention is to provide a streamlined muffler for use in conjunction with engine driven vehicles.

A yet further object of the present invention is to provide a muffler for internal combustion engines which does not materially reduce the power output of the engine.

A still further object of the present invention is to provide a muffler having a location of essentially constant pressure whereat a pressure takeoff fitting may be employed.

A yet further object of the present invention is to provide an adjustable flexible strap for positioning and maintaining a muffler in fluid communication with the exhaust port of an internal combustion engine.

These and other objects of the present invention will become apparent to those skilled in the art as the description thereof proceeds.

The present invention may be described with greater specificity and clarity with respect to the following drawings, in which.

Figure 1:
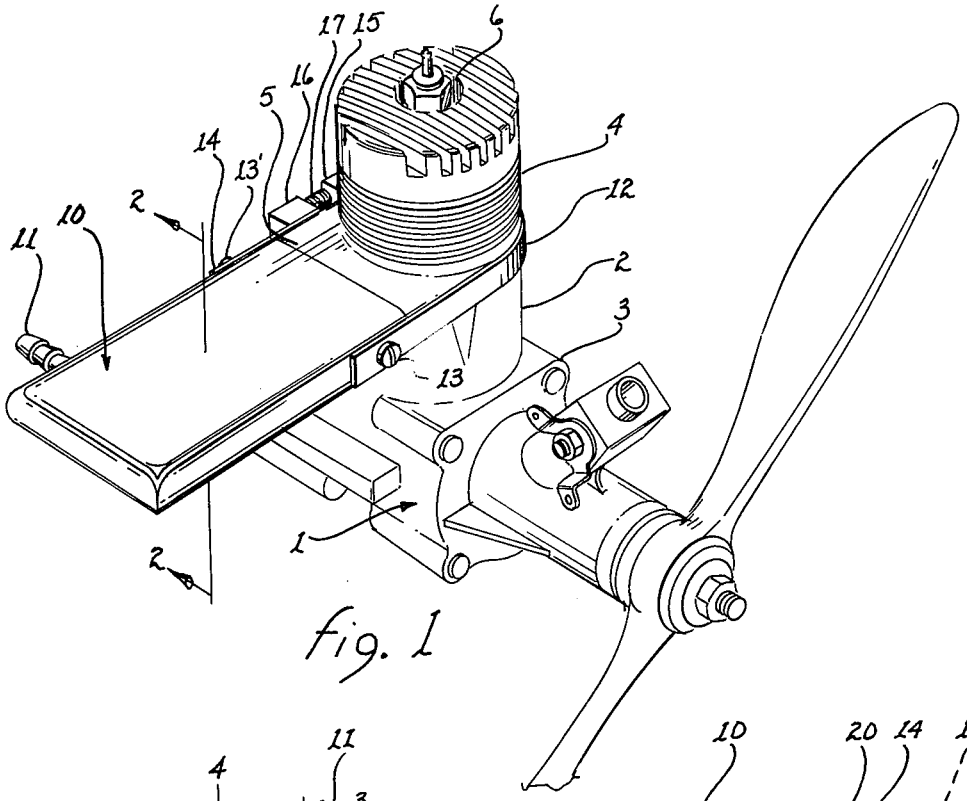
FIG. 1 illustrates the muffler strapped to the exhaust port of a representative miniature internal combustion engine.

Referring to FIG. 1, there is illustrated a representative single cylinder internal combustion engine 1, which engine is of the two cycle type normally used in model airplanes, model cars and model boats. The engine includes a cylinder 2 extending upwardly from crank case 3. Fins 4 are disposed about the upper end of the cylinder to dissipate the heat generated during combustion. A glow plug 6 serves as the ignitor for the periodically compressed combustible mixture. An exhaust stack 5 extends lateral to the cylinder and serves as a short conduit for the exhaust gases flowing through the exhaust port of the cylinder liner (not shown).

Muffler 10 abuts the outlet of exhaust stack 5 and is held in place by straps 12 and 14. One end of strap 12 is attached to a lateral side of muffler 10 by screw 13; the other end extends partially about cylinder 2 and is terminated by an apertured block 15. One end of strap 14 is attached to the opposite lateral side of muffler 10 by a screw 13'; the other end is terminated by a tapped block 16 in proximity to cylinder 2. A machine screw 17 extends through the aperture within block 15 for threaded engagement with tapped block 16 to draw muffler 10 sealingly adjacent exhaust stack 5 and retain it in place.

Other muffler attachment means, such as machine screws extending from the crank case or exhaust port into threaded engagement with muffler 10 may also be employed.

In some applications, a pressurized fuel system is employed. A pressure takeoff fitting 11 is threadedly inserted into communication with the interior of muffler 10. Thus, the pressure present within the muffler may be transmitted through fitting 10 and in fluid communication with the fuel system through a length of tubing.

Figure 2:
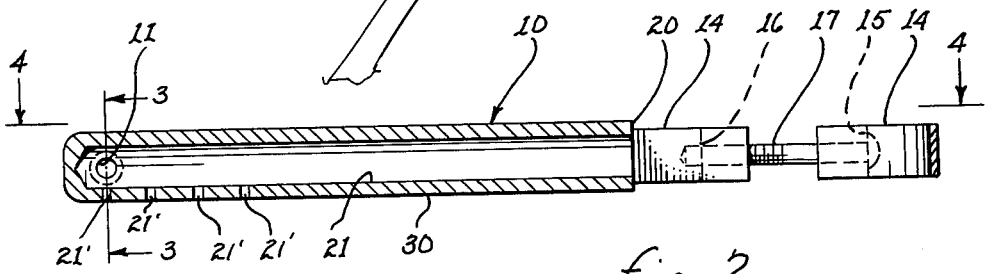
FIG. 2 is a cross-section of the muffler taken along lines 2—2, as shown in FIG. 1.
Figure 3:
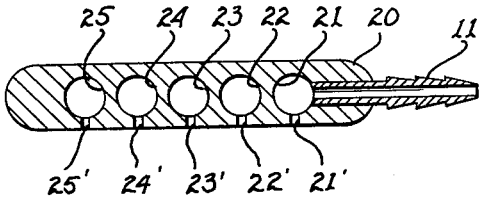
FIG. 3 is a cross-section of the muffler taken along lines 3—3, as shown in FIG. 2.
Figure 4:
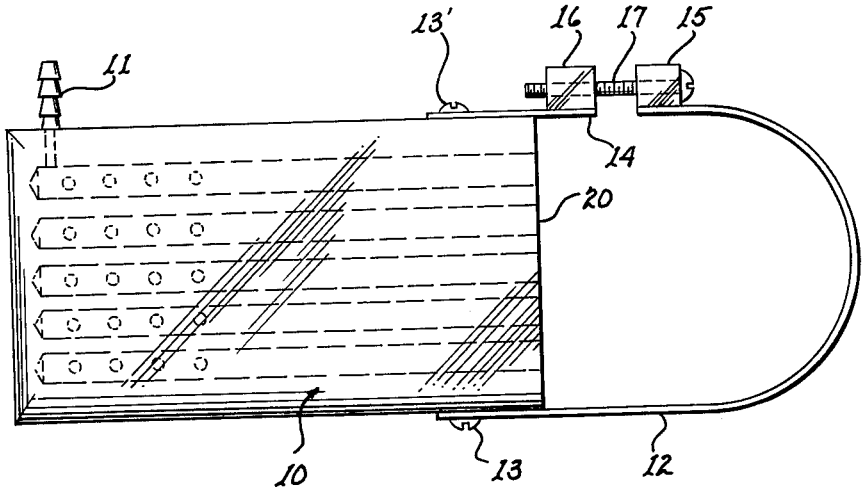
FIG. 4 is a top view of a muffler with an attachment strap and illustrating in phantom lines the cavities disposed within the muffler.

As illustrated in FIGS. 2, 3 and 4, muffler 10 is machined from solid stock. Hence, density discontinuities prevalent with prior art mufflers are obviated. The elimination of density discontinuities tends to eliminate sympathetic vibration within the audible range whereby induced muffler vibration is not responsible for the generation of sound. The elimination of plates or plate like elements within the muffler tends to preclude reverberation or other audible vibration common to flexible planar surfaces. The solid or monolithic structure is capable of presenting sufficient mass to serve effectively as a sound absorber for the range of frequencies of concern. As aluminum is an excellent heat conductor and as it is relatively lightweight, a muffler manufactured therefrom would readily dissipate the heat of the exhaust gases without incurring a substantial weight penalty. However, the manufacturing costs of prior art mufflers from aluminum is prohibitive. In contradistinction, the presently described muffler is readily and inexpensively machined from aluminum bar stock.

In the illustrated embodiment of the present invention, the muffler is depicted as a thin rectangular unit having planar upper and lower surfaces and three rounded lateral sides. When the muffler is used in conjunction with vehicles, the orientation of the engine is normally such that the planar surfaces are aligned with the airstream. That is, the muffler presents a minimal frontal area and the leading and trailing edges thereof are contoured to be aerodynamically efficient to minimize drag.

The butt end 20 of muffler 10 is essentially planar and abuts the outlet edge of exhaust stack 5. A plurality of cavities 21, 22, 23, 24 and 25 are drilled from the butt end into the muffler parallel to one another and in general alignment with the direction of flow of the exhaust gases through the exhaust stack. The diameter of cavities 21–25 is essentially coincident with the height of the outlet of exhaust stack 5. Thereby, the outlet edge of exhaust stack 5 bears against a solid surface of butt end 20 and an effective air seal can be established therebetween. The separation intermediate adjacent cavities 21–25 is at a minimum commensurate with sufficient wall thickness to establish enough of a webb intermediate the upper and lower surfaces of the muffler to prevent relative displacement therebetween.

A plurality of passageways 21', 22', 23', 24' and 25' are drilled from bottom surface 30 of muffler 10 into each of cavities21–25. These passageways serve to convey the exhaust gases into the surrounding atmosphere from the respective cavities. Moreover, the employment of a plurality of passageways per cavity tends to diffuse the wave form of the exhausted gases and dissipate the attendant energy thereof. The number of passageways per cavity to obtain the greatest sound muffling capability without appreciable back pressure buildup varies as a function of the exhaust gas volume output rate of the engine.

Although the sound muffling capability of the present invention is not completely and fully understood, certain assumptions can be made. It is believed that the employment of a plurality of cylindrical cavities 21–25 tend to produce multiple degenerative reflections of the audible frequency wave forms as the latter travel from the butt end to the tip of the muffler, which reflections progressively cause deterioration of the wave form and attenuate the audible frequencies. Similarly, the sharply defined pressure wave forms emanating from the combustion chamber are distortingly reflected and attenuated by the curved surfaces. This theory is somewhat substantiated by the pressure sensed at the pressure takeoff fitting 11 at the tip of the muffler. Through tests, it has been determined that the pressure present at the tip ends of the cavities is essentially uniform with only minor perturbations. In the invention as presently constructed and used, cavities 21–25 are machined with normal drill bits. Such bits leave a cone-like depression at the extremities of the cavities and it is believed that the surface of these cones further degeneratively reflect the audible frequency wave forms against the curved sides of the cavities and not directly back toward the engine exhaust port. Thus, all reflecting surfaces within the cavities are curved surfaces, which type of surfaces tend to particularly distort any audible frequency wave form impinging thereon.

The multiple and continuing reflections of the exhaust gases forced into the cavities tend to dissipate the kinetic energy of the exhaust gases and thereby translate their velocity into pressure. The plurality of passageways located at the tip end of the muffler and within a near uniform pressure environment dissipate the pressure by allowing the exhaust gases to escape downwardly into the atmosphere and effectively preclude pressure buildup. As the pressure buildup is precluded by a non-pulsating pressure environment, very little back pressure exists within the present invention and the power loss therefrom of a muffled engine is of a near insignificant value.

As alluded to above, the number of cavities within the muffler is a function of the cross-sectional area of the outlet of the exhaust stack. In practice, it has been learned that by matching the diameter of the cavities to the depth of the exhaust stack and employing a number of cavities commensurate with the width of the exhaust stack outlet the same muffling capability is achieved for any engine displacement size. It may be noted in passing, that as the total transverse cross-sectional area of the cavities is not greater than the transverse cross-sectional area of the exhaust stack outlet, the present invention is not an expansion type muffler, as defined by the cognoscente.

For particular applications, such as internal combustion engine powered model cars, where space is at a premium, a muffler employing the principles of the present invention but in a slightly different physical configuration serves admirably to muffle the exhaust noises. The muffler body was constructed to have a single cylindrical cavity commensurate with the exhaust port of the engine and terminated at the tip by a plurality of passageways, the axes of which were in alignment with the axes of the cavity. Herein, the cavity itself still presented to the audible frequency wave forms of the exhaust gases curved reflecting surfaces, including a cone-like depression at the end thereof, which surfaces distorted and attenuated the audible frequencies to an acceptable level. Herein too, the pressure at the tip of the cavity was essentially uniform and the passageways extending therefrom to the atmosphere precluded pressure buildup to the extent of not incurring any significant power loss of the muffled engine.

While the present invention was primarily developed to meet the need for muffling model airplane engines, it is anticipated that the muffler described herein is equally useable in conjunction with both two cycle and four cycle engines used in other than modeling activities. In example, as motorcycles cannot or do not employ mufflers of the size useable with automobiles, they are very poorly muffled. However, as the present invention does not operate in conformity with the principles of the presently available effective mufflers and therefore does not have to be of commensurate size, it is well adaptable to both two and four cycle motorcycle engines. Additional areas of immediate utilitarian need exist in the field of subcompact and compact cars where space is at a premium. Moreover, the present invention may be effectively employed with two cycle and four cycle motorboat engines.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A monolithic muffler mounted in fluid communication with an exhaust stack of an internal combustion engine for damping the noise generated during combustion within the engine, said muffler comprising in combination:

a. a one piece body having a butt end in engagement with the outlet of the exhaust stack for minimizing reverberation and vibration induced by the exhaust gases expelled from the exhaust stack;

b. a plurality of cavities collectively having a transverse cross-sectional area no greater than the cross-sectional area of the exhaust stack outlet and extending from the butt end into said body for receiving the exhaust gases flowing through the exhaust stack outlet, c. each cavity of said plurality of cavities having curved surfaces for reflecting the pressure and audible frequency wave forms generated by the combustion within the engine;

d. each adjacent cavity being separated one from another by a solid separation;

e. at least one passageway extending from each said cavity for conveying the exhaust gases within the corresponding one of said cavities into the atmosphere;

f. whereby, said plurality of cavities attenuate the pressure and audible frequency wave forms of the exhaust gases expelled from the engine and said plurality of passageways diffusingly convey the exhaust gases into the atmosphere.

2. The muffler as set forth in claim 1 wherein the diameter of each of said cavities is no greater than the depth of the outlet of the exhaust stack.

3. The muffler as set forth in claim 2 wherein the terminating end of each of said cavities comprises a cone-shaped depression.

4. The muffler as set forth in claim 3 wherein the longitudinal axis of each of said passageways extends lateral to the longitudinal axis of the respective one of said plurality of cavities.

5. The muffler as set forth in claim 4 wherein more than one of said passageways extend from each of said plurality of cavities.

6. The muffler as set forth in claim 1 wherein the longitudinal axis of each of said cavities are aligned parallel to one another in a common plane.

7. The muffler as set forth in claim 6 wherein said body is a thin rectangular block having an upper planar surface and lower planar surfaces and adjacent ones of said plurality of cavities are spaced apart from one another to establish webs within said body for supportingly separating the upper and lower planar surfaces.

8. The muffler as set forth in claim 7 including a pressure takeoff fitting in fluid communication with one of said plurality of cavities, said fitting being disposed at a point removed from the exhaust stack.

9. The muffler as set forth in claim 7 wherein said body is aluminum.

10. The muffler as set forth in claim 7 wherein each of said passageways extend from a respective one of said plurality of cavities to the lower surface of said body.

11. The muffler as set forth in claim 1 wherein said body is a thin rectangular block having an upper planar surface and lower planar surface, and an outer exhaust end, said butt end having a contacting surface effective to abut the outlet edge of an exhaust stack, said cavities extending from the contacting surface to the outer exhaust end of the body.

12. The muffler as set forth in claim 1 wherein said internal combustion engine has a combustion chamber and said muffler includes a means for mounting said muffler in fluid communication with said exhaust stack, said mounting means including a first strap attachable to one lateral side of the muffler and partially circumscribing the outer periphery of the combustion chamber said mounting means further including an apertured block and a second strap having one end attachable to another lateral side of the muffler and partially circumscribing the outer periphery of the combustion chamber, said apertured block being disposed at one end of said first strap, said mounting means further including a tapped block disposed at the other end of the second strap, and said mounting means including screw means for drawing said tapped block toward said apertured block whereby said first and second straps retain the muffler adjacent the exhaust port.

13. A monolithic muffler for use at the outlet edge of an exhaust stack to dampen noise generated by an internal combustion engine, said muffler comprising:

a. a one piece body having a butt end and an outer exhaust end, b. said butt end having a contacting surface effective to abut said outlet edge, c. a plurality of elongated cavities having a curved cross-section and extending from said contacting surface to the outer exhaust end of the body, d. each adjacent cavity having an intermediate, solid web separation therebetween, and e. at least one passageway extending from each said cavity at the outer exhaust end of the body, f. said passageways being effective to convey the exhaust gases from within the corresponding one of said cavities into the atmosphere.

14. The muffler as set forth in claim 13 wherein each cavity is a cylindrical bore opening at one end thereof on said contacting surface.

15. The muffler as defined in claim 14 wherein each cavity has a terminating end located at the outer exhaust end of the body, each said terminating end includes a cone shaped depression.

16. The muffler as set forth in claim 13 wherein the longitudinal axis of each cavity is aligned parallel with respect to each other, there are a plurality of passageways directed outwardly from each cavity and disposed along each longitudinal axis at said outer exhaust end of the body.

17. The muffler as set forth in claim 16 wherein each cavity is a cylindrical bore opening at one end thereof on said contacting surface, the passageways have a diameter that is less than the diameter of the cavities.

* * * * *